United States Patent [19]

Reichelt

[11] Patent Number: 4,976,089

[45] Date of Patent: Dec. 11, 1990

[54] PACKING APPARATUS WITH DEFECTIVE WRAPPER SHEET ELIMINATING MEANS AND METHOD

[75] Inventor: Wolfgang Reichelt, Gottmadingen, Fed. Rep. of Germany

[73] Assignee: Sig Schweitzerische Industrie-Gesellschaft, Neuhausen am Rheinfall, Switzerland

[21] Appl. No.: 469,773

[22] Filed: Jan. 9, 1990

[30] Foreign Application Priority Data

Jan. 13, 1989 [CH] Switzerland ..... 109/89

[51] Int. Cl.[5] ..... B65B 41/16; B65B 57/02

[52] U.S. Cl. ..... 53/53; 53/389; 83/80; 83/98; 83/100; 83/106

[58] Field of Search ..... 53/53, 54, 52, 389, 53/64, 65, 66, 505, 506, 435, 520; 83/73, 80, 106, 105, 98, 100

[56] References Cited

U.S. PATENT DOCUMENTS 2,617,528 11/1952 Moore ..... 83/106 X
4,135,344 1/1979 Seragnoli ..... 53/389 X
4,405,126 9/1983 Frye et al. ..... 83/98 X
4,541,221 9/1985 Seragnoli ..... 53/54
4,934,228 6/1990 Bolton et al. ..... 83/106 X

FOREIGN PATENT DOCUMENTS 3702391 8/1988 Fed. Rep. of Germany .

*Primary Examiner*—James F. Coan
*Attorney, Agent, or Firm*—Spencer & Frank

[57] ABSTRACT

A packing apparatus has an input device which includes an advancing device for forwarding a wrapper sheet of indefinite length in a feeding direction along a conveying path; a processing device for performing an operation on the wrapper sheet; a cutting device severing the wrapper sheet transversely to the feeding direction for consecutively forming wrapper sheet lengths; and a bag-shaping device arranged downstream of the input device as viewed in the feeding direction, for receiving wrapper sheet lengths from the input device. The input device comprises a monitoring device for sensing the wrapper sheet and for generating a signal upon detecting a defect in the wrapper sheet and a deflecting device arranged downstream of the monitoring device and the cutting device for deflecting a defective wrapper sheet, in response to the signal, out of the conveying path into a waste position.

11 Claims, 2 Drawing Sheets

PACKING APPARATUS WITH DEFECTIVE WRAPPER SHEET ELIMINATING MEANS AND METHOD

CROSS REFERENCE TO RELATED APPLICATION

This application claims the priority of Swiss Application No. 109/89-2 filed Jan. 13th, 1989, which is incorporated herein by reference.

BACKGROUND OF THE INVENTION

This invention relates to a packing apparatus which has a bag-shaping machine for making bags to be filled with goods to be packaged. The bags are made from a wrapper sheet which is fed to the bag-shaping machine by means of an input device having a wrapper sheet supply system and at least one processing station as well as a cutting device which transversely severs the wrapper sheet into predetermined lengths.

German Offenlegungsschrift No. (application published without examination) 3,702,391 discloses an apparatus which cyclically supplies packing material to a bag-shaping machine and which has a supply roller pair forwarding a wrapper sheet of indefinite length continuously and at constant speed as well as a transverse cutting device. For cyclically advancing a wrapper length severed from the wrapper sheet of indefinite length to a folding device of the bag-shaping machine a feeding device is provided downstream of the transverse cutting device for assuming conveyance of the severed wrapper sheet length and advancing the same to the folding device at a speed which is greater than the advancing speed of the wrapper sheet of indefinite length.

In an apparatus of the above-outlined type, the wrapper sheet is advanced between notching rollers, the upper and lower blade of the transverse cutter and between two drawing rollers to a sheet feeder. In case a wrapper sheet is used where a bonding by an adhesive has to be effected, a gluing device is associated with the lower roller of a feed roller. The gluing device has an applicator roller which applies an adhesive to the wrapper sheet for the longitudinal and transverse seam of the bag to be formed in the downstream-arranged bag-shaping machine. Such a packing apparatus has the drawback that after the machine is brought to a standstill, the adhesive extending from the adhesive-applying roller to the two drawing rollers may dry out so that when the machine is restarted, no appropriately glued bags can be formed about the folding mandrel of the bag-shaping machine. Such an occurrence necessarily leads to operational malfunctions. In order to eliminate such disturbances, in apparatuses of the above-outlined type and of similar type the dried adhesive is manually removed from the machine which is a dangerous and time-consuming practice. Or, as an alternative, the defectively glued bags are scrapped at a location downstream of the filling station.

SUMMARY OF THE INVENTION

It is an object of the invention to provide an improved packing apparatus of the above-outlined type from which the discussed disadvantages are eliminated.

This object and others to become apparent as the specification progresses, are accomplished by the invention, according to which, briefly stated, the input device is provided with a monitoring device for detecting defects in the wrapper material and a deflector which, in response to a sheet-defect indicating signal emitted by the monitoring device, deflects the leading end of a defective sheet portion to be scrapped, out of the plane of normal sheet advance and guides the defective sheet portion into a waste (scrapping) position.

By virtue of the invention as outlined above, no portions of the wrapper sheet that carries dried adhesive or other defects is admitted into the bag-shaping machine so that operational disturbances are significantly reduced. Furthermore, by virtue of the apparatus structured according to the invention it is feasible to utilize adhesives of a shorter binding period than it has been feasible heretofore to thus make possible an increase in the machine output.

DESCRIPTION OF THE PREFERRED EMBODIMENTS

Figure 1:
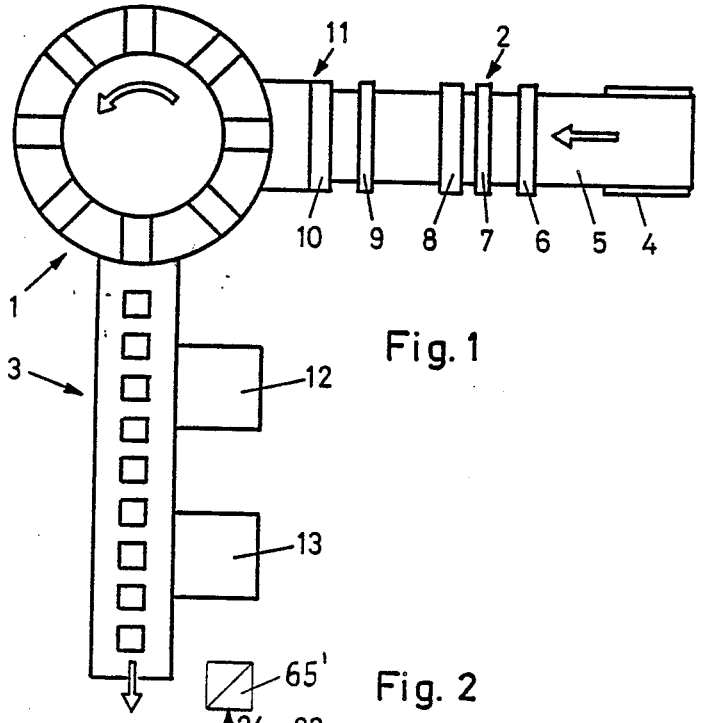
FIG. 1 is a schematic top plan view of a packing apparatus incorporating the invention.

Turning to FIG. 1, the packing apparatus shown therein comprises a bag-shaping machine 1 for making bags of a wrapper sheet, an input device 2 for advancing wrapper sheet lengths to the bag-shaping machine 1 and an output device 3 for charging and closing the bags supplied by the bag-shaping machine 1. The input device 2 includes a supply core 4 on which there is supported a reel of wrapper sheet 5 which is pulled off and advanced to the bag-shaping machine 1 through two processing stations 6, 7, a monitoring station 8, a sheet-advancing device 9, a cutting device 10 and a waste separating (scrapping) station 11. The outlet of the bag-shaping machine 1 adjoins the output device 3 which comprises a station 12 for filling the bags, for example, with flowable bulk material, and a closing station 13 for closing the filled bags. While, as illustrated, the bag-shaping machine 1 comprises a multi-mandrel wheel where the mandrels are oriented in spoke-like fashion, it will be understood that the invention is not limited to a bag-shaping machine of such a configuration.

Also referring now to FIG. 2, the processing station 6 comprises an adhesive-applying device 21 and a roller system 22, while the processing station 7 comprises a tearing strip-applying device 23 which cyclically provides the wrapper sheet 5 with a tearing strip by means of which the subsequently formed package may be opened by the consumer. The adhesive-applying device 21 comprises an adhesive tub 211 in which there is disposed a relatively large-diameter rotating roller 212 which is in a peripheral, torque-transmitting contact with an adhesive-applying roller 213 cooperating with a counterroller 214. The wrapper sheet 5 passes between the roller pair 213, 214. The monitoring station 8 comprises a monitoring device 24 which has an optical barrier capable of sensing defects in the wrapper sheet 5 caused by a defective application of a tearing strip by the tearing strip-applying device 23. The sheet-advancing device 9 comprises two cooperating sheet-advancing rollers 251, 252 as well as a drive 253. The cutting device 10 comprises an upper knife blade 261 and a lower knife blade 263 operated by a drive 262. A motor 27 is provided for driving the roller 212, the tearing strip-applying device 23 as well as the drive 262.

The separating station 11 comprises a guide plate 281 which is pivotal in a vertical plane about an axis 282 by means of a pivoting mechanism 283 as well as a removable waste container 284. The guide plate 281 has an upper flat side which extends from the zone of the axis 282 to the zone of the knives 261 and 263. The edge of the flat upper side of the guide plate 281 has, in the zone of the knife assembly 261, 263, a downwardly oriented deflector plate 285 which is of concave shape as viewed from the knife assembly 261, 263.

It is to be understood that it is feasible to arrange the guide plate 281 such that the distance of the deflector plate 285 from the cutter 261, 263 is greater than the length of the sheet lengths 5'. In such a case the defective sheet length 5' is first severed from the wrapper sheet 5 by the cutter 261, 263 and only thereafter is its leading edge deflected by the deflector plate 285.

In the description which follows, the operation of the above-described packing device will be set forth.

The wrapper sheet 5 is, in a conventional manner, taken off the supply core 4 and is guided through the processing stations 6, 7 and is transversely severed into a sheet length by the cutting device 10. Upon determination of a wrapper sheet defect by the monitoring device 8, which defect may have originated in either or both of the processing stations 6, 7, a corresponding defect signal is generated which, by means of a conventional electronic, fluidic or mechanical control device causes an actuation of the pivoting mechanism 283. The operation of the control device will be described in more detail later, with reference to FIG. 6. The pivoting mechanism 283 effects an upward movement of the guide plate 281 in such a manner that the leading end of the wrapper sheet 5 abuts against the concave face of the deflector plate 285 and is thus guided downwardly toward the waste container 284. Severance of the sheet 5 into a sheet length 5' occurs in a normal, cadenced manner, so that if no defect signal is generated, the severed wrapper sheet length 5' moves on the upper face of the guide plate 281 to the bag-shaping device 1, whereas a defective severed sheet length 5' —deflected by the raised deflector plate, 285 prior to severance—drops into waste container 284. Thus, defective wrapper sheet lengths may be removed from the production line without disrupting the operation.

Figure 2:
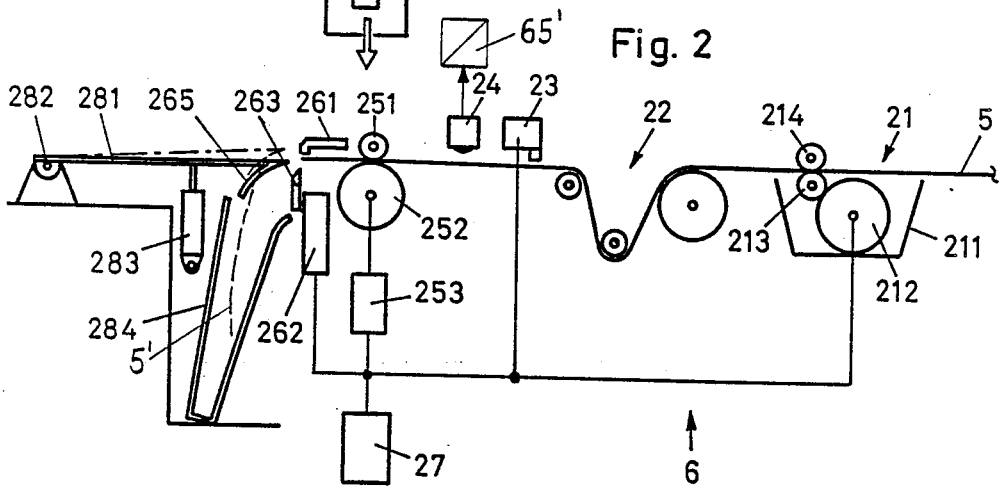
FIG. 2 is a schematic side elevational view of a preferred embodiment of the invention.
Figure 3:
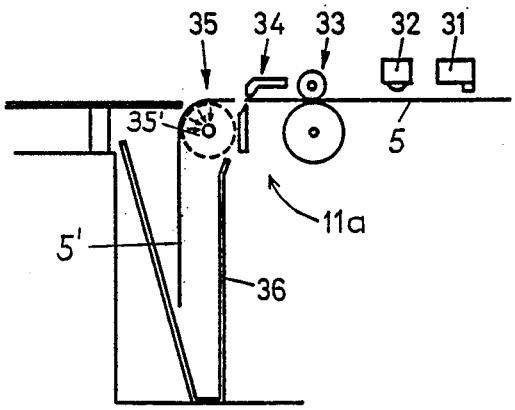
FIGS. 3, 4 and 5 are schematic side elevational views of three further preferred embodiments of the invention.

Turning now to FIG. 3, the input device 11*a* has a tearing strip-applying device 31, a monitoring device 32, a sheet-advancing system 33 and a cutting device 34 of the type described earlier. The separating device 35 of this embodiment, however, has a deflecting arrangement constructed differently from that described in connection with the FIG. 2 embodiment. The deflecting device 35 has a suction roller 35' which has a perforated surface and a vacuum arrangement which, when energized, causes an air stream to pass radially through the roller from the outside. The vacuum source is energized only upon detection of a defect by the monitoring device 32. Since the suction roller 35' is situated underneath the wrapper sheet 5, when suction is present, the leading end of the wrapper sheet 5 adheres to the suction roller 35' and, as the latter rotates, the wrapper sheet 5 is moved out of its conveying plane downwardly and is thus not advanced to the bag-shaping machine 1 but is caused to fall, by its own weight, into the waste container 36.

Figure 4:
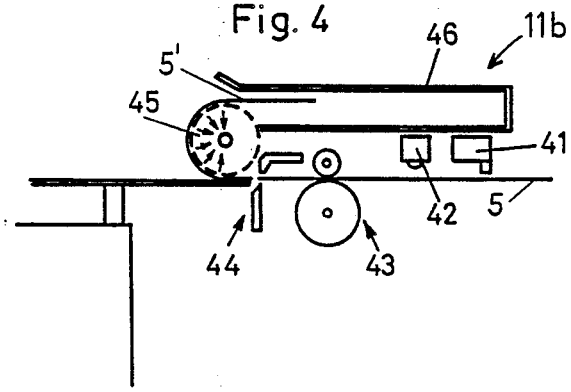

Turning now to the embodiment illustrated in FIG. 4, the input device 11*b* has a tearing strip-applying device 41, a monitoring device 42, a wrapper sheet-advancing device 43, a cutting device 44 and a suction roller 45 which is positioned above the conveying path of the wrapper sheet 5. By virtue of this arrangement, the defective wrapper sheet 5 is, by virtue of the radial suction force and tangential force of the rotating suction roller 45, deflected arcuately upwardly and then guided rearwardly into a horizontally oriented waste container 46.

Figure 5:
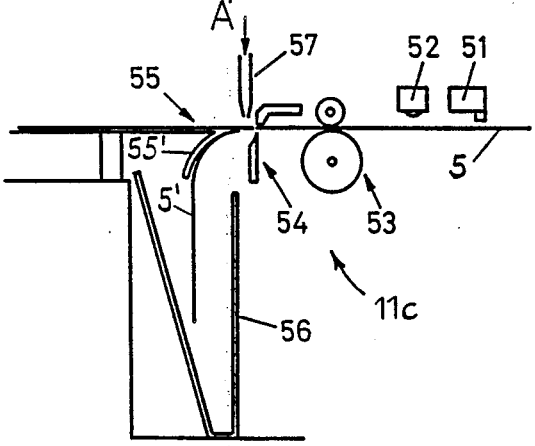

The input device 11*c* illustrated in FIG. 5 has a tearing strip-applying device 51, a monitoring device 52, a wrapper sheet advancing device 53, a transverse cutting device 54 and a fixed guide plate 55 structured similarly to the guide plate 281 of the FIG. 2 embodiment. Thus, the guide plate 55 has an arcuate, downwardly extending deflector plate 55' which, similarly to the deflector plate 285 in FIG. 2, is concave as seen from the cutting device 54. Underneath the deflector plate 55' there is situated a vertically oriented, removable waste container 56. Between the deflector plate 55' and the cutting device 54 there is oriented a downwardly directed air nozzle 57 arranged to direct an air blast downwardly on the top of the leading edge of the advanced wrapper sheet 5. The air nozzle 57 operates only as a function of a sheet defect detector signal generated by the monitoring device 52. Upon such an air blast, the leading edge of the wrapper sheet 5 is bent downwardly and forced against the concave part of the deflector plate 55' and thus the defective wrapper sheet is guided downwardly into the waste container 56.

Figure 6:
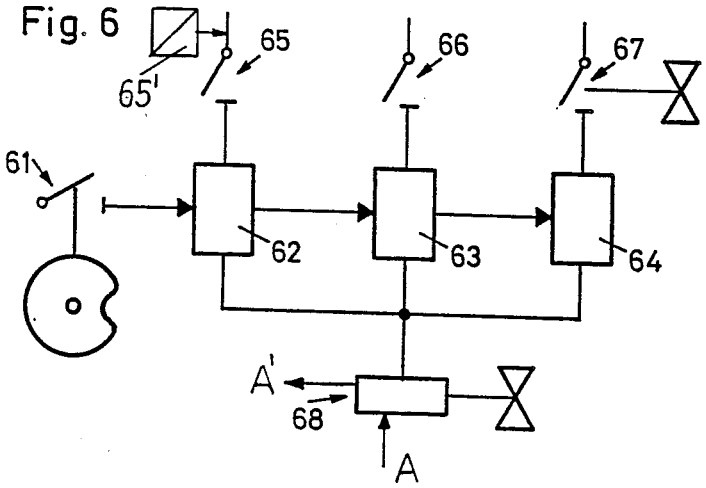
FIG. 6 is a block diagram illustrating a control arrangement forming a part of the preferred embodiments.

Turning now to FIG. 6, there is illustrated therein, in block diagram form, a control device for the sheet deviating (scrapping) arrangement shown in different embodiments in FIGS. 2–5. The control device includes a pulse generator 61 which, for each wrapper sheet length or knife stroke transmits a shift pulse applied to the input of each shift register 62, 63 and 64. Each shift register 62, 63 and 64 has a settable step number. Such an adjustability ensures that in case the longitudinal dimension of the sheet lengths 5' is to be changed—for example, when the package height is to be altered—a correct separation of defective wrapper sheets continues to take place. Thus, for example, it is assumed that the processing stations 6, 7 and the monitoring station 8 are spaced from the cutting device 10 at a distance which corresponds to one to three wrapper sheet lengths 5'. If, for example, a series of packages is to be prepared which should have a lesser height than the earlier manufactured series, a shorter sheet length is needed, and for this purpose the above-noted distance is shortened as well. Accordingly, the shift registers 62, 63, 64 are to be newly set to ensure a correct separation of the defective sheets even in case of shortened sheet lengths.

A monitoring signal indicating a sheet defect due to a faulty tearing strip (for example, because of malfunctioning of the tearing strip-applying device 23) is applied by the monitoring device 24 to a relay 65' having switch contacts 65. In response to such signal the contacts 65 close, applying an input signal to the shift register 62.

The monitoring signal of another faulty condition, for example, an incorrect centering of the wrapper sheet is applied to an input of the shift register 63 when the contact switch 66 of the associated, non-illustrated relay closes.

The third shift register 64 may be provided to respond to an unsatisfactory start-up condition of the machine. For this purpose, the associated contact switch 67 operates with a preset delay. Thus, for example, let it be assumed that the packing machine is stopped and then restarted after 20 seconds. An adhesive having a longer drying time does not dry during such a period and therefore no wrapper sheet elimination occurs whereby wrapper sheet losses are avoided. To achieve such a result, the delay switch 67 is set, for example, to 30 seconds. Thus, the setting of the delay switch 67 is set as a function of the drying properties of the particular adhesive which is being used by the machine. In case an adhesive having a shorter drying period is being used, the delay switch 67 has to be set to a shorter period, for example, 15 seconds. Thus, upon a restart of the machine after a 20-second interruption, wrapper sheets 5' will be separated as waste.

In case any one of the shift registers 62, 63 or 64 receives a fault signal through the respective switch 65, 66 or 67 and the shift registers 62, 63 and 64 have received the set number of pulses from the pulse generator 61, the shift register to which the fault signal has been applied, transmits an actuating signal to a fluidic valve circuit 68. The valve circuit 68 has an input to which pressurized air A is applied. In case the valve circuit 68 receives a signal from any of the shift registers 62, 63 or 64, pressurized air A' will appear at an output of the valve circuit 68 and is applied to the sheet deflecting device, thus, for example, to a fluid power cylinder of the pivoting mechanism 283 (FIG. 2) or to the nozzle 57 (FIG. 5) to thus cause activation of the separating station 11 for deflecting a wrapper sheet length 5' for waste separation. It will be understood that, for example, in case the sheet separating device is constructed in accordance with the embodiments illustrated in FIGS. 3 and 4, a suction is applied to an input of the valve circuit 68 and, accordingly, upon actuation of the valve circuit 68 by any of the shift registers 62, 63 or 64, a suction is applied to the inside of the suction roller 35' (FIG. 3) or 45 (FIG. 4).

It will be understood that the above description of the present invention is susceptible to various modifications, changes and adaptations, and the same are intended to be comprehended within the meaning and range of equivalents of the appended claims.

What is claimed is:

1. In a packing apparatus including an input device having advancing means for forwarding a wrapper sheet of indefinite length in a feeding direction along a conveying path;

processing means for performing an operation on the wrapper sheet;

a cutting device severing the wrapper sheet transversely to the feeding direction for consecutively forming wrapper sheet lengths; and a bag-shaping device arranged downstream of said input device as viewed in the feeding direction, for receiving wrapper sheet lengths from said input device;

the improvement wherein said input device comprises monitoring means for sensing said wrapper sheet and for generating a defect signal upon detecting a defect in the wrapper sheet and deflecting means arranged downstream of said monitoring means and said cutting device for deflecting a defective wrapper sheet, in response to said defect signal, out of the conveying path into a waste position, thereby preventing the defective wrapper sheet from being introduced into the bag-shaping device.

2. A packing apparatus as defined in claim 1, wherein said deflecting means comprises a roller having an apertured cylindrical surface and means generating an air current passing radially inwardly through said surface upon generation of said defect signal; said roller being generally tangential to said conveying path, whereby a wrapper sheet, passing in a zone of said cylindrical surface, adheres thereto and is deflected from the conveying path upon operation of the means generating an air current.

3. A packing apparatus as defined in claim 1, wherein said processing means comprises an adhesive-applying means for providing a surface of the wrapper sheet with an adhesive.

4. A packing apparatus as defined in claim 1, further comprising a removable waste container positioned to receive defective wrapper sheets from said deflecting means.

5. A packing apparatus as defined in claim 1, further comprising a control device having an input connected to said monitoring means for receiving said defect signal; said control device being connected to said deflecting means for operating said deflecting means upon receipt of said defect signal.

6. A packing apparatus as defined in claim 5, wherein said control device includes pulse generating means for generating a number of pulses representing a desired longitudinal dimension for the wrapper sheet lengths; said control device further including means to apply an actuating signal to said deflecting means upon receipt of the defect signal and said number of pulses.

7. A packing apparatus as defined in claim 1, wherein said deflecting means comprises a guide plate including a deflector plate arranged to be abutted, in response to said defect signal, by a leading edge of a defective wrapper sheet.

8. A packing apparatus as defined in claim 7, further comprising support means for pivotally holding said guide plate for providing movement thereof into a first and a second position; in said first position said guide plate lying in said conveying path for guiding the wrapper sheets to said bag-shaping device, and in said second position said guide plate being oriented such that the deflector plate thereof is placed in the conveying path for abutting and deflecting the leading edge of a defective wrapper sheet.

9. A packing apparatus as defined in claim 7, wherein said deflecting means further comprises an air nozzle arranged in a zone of said deflector plate and oriented such that upon generation of said defect signal said air nozzle emits an air stream directed on a leading edge of a defective wrapper sheet for deflecting the defective wrapper sheet out of the conveying path into contact with said deflector plate.

10. A method of eliminating a defective wrapper sheet length in a packing apparatus having a bag-shaping means for forming bags from wrapper sheet lengths and an input means for advancing wrapper sheet lengths to said bag-shaping means in a conveying path; comprising the following steps:

(a) advancing a sheet of wrapper of indefinite length in said input means in a feeding direction along a conveying path;

(b) severing the sheet in said input means into sheet lengths;

(c) monitoring the advancing wrapper for defects in the input means;

(d) generating a signal upon detection of a defect in the advancing wrapper;

(e) deflecting, in response to said signal, a leading edge of the wrapper from said conveying path; and (f) subsequent to step (e), directing the wrapper sheet length, having said leading edge and containing said defect, into a waste position from said input means.

11. A method as defined in claim 10, wherein step (c) is performed on the sheet of wrapper of indefinite length and step (e) is performed prior to step (b) which severs, from the sheet of wrapper of indefinite length, a sheet length containing said defect.

* * * * *